US005560740A

United States Patent [19]

Castle et al.

[11] Patent Number: 5,560,740

[45] Date of Patent: Oct. 1, 1996

[54] CABLE ATTACHMENT DEVICE TO SPIN SINGLE CABLES INTO RESINOUS ANCHORS IN BOREHOLES IN GEOLOGIC FORMATION

[75] Inventors: Brian R. Castle; James J. Scott, both of Rolla, Mo.

[73] Assignee: Scott Investment Partners, Rolla, Mo.

[21] Appl. No.: 360,261

[22] Filed: Dec. 20, 1994

[51] Int. Cl.[6] ..... E21D 20/00; E21D 21/00

[52] U.S. Cl. ..... 405/259.6; 405/302.2; 403/268

[58] Field of Search ..... 405/302.2, 302.1, 405/259.6; 403/268, 265

[56] References Cited

U.S. PATENT DOCUMENTS

| | | | |
|---|---|---|---|
| 2,850,937 | 9/1958 | Ralson . | |
| 3,226,934 | 1/1966 | Emery . | |
| 3,478,523 | 11/1969 | Reusser . | |
| 4,043,690 | 8/1977 | Browne | 403/268 |
| 4,265,571 | 5/1981 | Scott | 405/302.2 X |
| 4,378,180 | 3/1983 | Scott . | |
| 4,673,309 | 6/1987 | Schlaich et al. | 403/268 X |
| 4,784,531 | 11/1988 | Calandra | 405/259.6 X |
| 5,230,589 | 7/1993 | Gillespie . | |
| 5,253,960 | 10/1993 | Scott . | |
| 5,462,391 | 10/1995 | Castle et al. | 405/302.2 |

FOREIGN PATENT DOCUMENTS

| | | | |
|---|---|---|---|
| 257645 | 3/1988 | European Pat. Off. | 405/259.6 |
| 1608289 | 7/1973 | Germany | 405/302.2 |
| 899997 | 2/1982 | U.S.S.R. | 405/259.6 |

*Primary Examiner*—Anthony Knight
*Attorney, Agent, or Firm*—Webb Ziesenheim Bruening Logsdon Orkin & Hanson, P.C.

[57] ABSTRACT

A method of anchoring a spirally wound multi-strand cable in a borehole by using resinous material intermixed with the cable strands upon gripping the cable strands at one end to unwind the strands initially for forcing the cable into a borehole and for rewinding the strands to restore the cable to its spirally wound condition, and apparatus for applying cable rotating and thrusting reaction for securing retention of the cable in a borehole with a resinous anchor material.

8 Claims, 3 Drawing Sheets

CABLE ATTACHMENT DEVICE TO SPIN SINGLE CABLES INTO RESINOUS ANCHORS IN BOREHOLES IN GEOLOGIC FORMATION

BACKGROUND OF THE INVENTION

1. Field of the Invention

Cable attachment system in which a single multi-strand cable is gripped so it can be rotated into resinous anchorage material in a borehole in the geologic formation of a mine passage with a length of the cable protruding into the passage for attachment of a variety of suitable devices to prevent failure of the geologic formation.

2. Description of the Prior Art

It is known that in the creation of underground passages in geologic material ground stresses or forces are released which cause strains in the geologic material surrounding the passage. The strain is reflected by the movements of the material and this is especially true in the roof and ribs of the openings. Many systems have been developed to resist these forces and reestablish a balance of stability by retarding the movement of the geologic material, not only in the roof but around the passage. An early form of roof bolt was disclosed by Ralson U.S. Pat. No. 2,850,937 on Sep. 9, 1958. In this disclosure the roof bolt embodies indicated means which can be seen and which convey information regarding whether or not the roof bolt is supporting its desired load in the mine.

References also are made to Emery U.S. Pat. No. 3,226,934 of Jan. 4, 1966, and Reusser U.S. Pat. No. 3,478,523 of Nov. 18, 1969, each directed to rock bolts having a load bearing plate for use in mine roof support. Other patents exist on roof bolts, fixtures, and on cable anchor fixtures which include Scott U.S. Pat. No. 4,378,180 of Mar. 29, 1993, Scott U.S. Pat. No. 5,253,960 of Oct. 19, 1993, as well as Gillespie U.S. Pat. No. 5,230,589 of Jul. 27, 1993.

Past practice in the mining industry has been to use mechanical type anchor bolts using steel heading, threaded rods, coupled if necessary for longer than seam height, and to use rebar steel anchored in resin where anchor problems exist. While these systems are still widely used, a recent trend has been to use cables in place of steel rods or rebars in the support systems. This has been particularly true where mine operators need to place long bolts in low seam heights, which requires coupling of the parts of the fixture and a weakening of the fixture due to the couplings. Couplings increase the cost and the threads of the rod produce stress concentrations which weaken the overall support. Cable type roof bolts, for example a 7-strand ⅝" or ½" diameter cable, can be readily placed in small diameter holes in low seams by bending the cable to obtain insertion and eliminate couplings. A difficulty with a cable support is it is hard to make an attachment to the cable which will allow rotation of the cable upon insertion. While rigid attachments can be placed on the cable, such as devices with tapered holes and locking jaws or socketed connectors, or perhaps, wrenches which use set screws or rigid clamping devices to hold the cable while spinning, are possible but are cumbersome, expensive and may interfere with attachment of other articles to the cable end.

SUMMARY OF THE INVENTION

It is therefore one of the principle objects of the inventions to provide an attachment system to the end of a single, 7-strand cable in the form of a wrench or pipe with a series of ports for entry of individual strand wires to allow an attachment to thrust and rotate a single cable into a resinous material pushed into the base of a borehole.

It is a further object of the invention to provide a special tool to allow quick opening of the wire strands at the end of the cable where attachment is made so that an attachment wrench can readily be put in place to receive the individual strands.

Another object of the invention is to provide a hand operated method for opening the individual wire strands of the 7-strand cable by using a simple twist or T-wrench.

Another object of the invention is to provide a wrench-like device of a predetermined length that will assure the desired length of cable protruding from the hole after installation of the cable in the resinous material so that as the wrench moves the cable to a point of rock contact with the closed end of the borehole, thrusting is stopped and the assured desired length of cable thus protrudes from the borehole.

A further object of the invention is to provide an attachment wrench which will slide off and quickly release from the cable, exposing the bare wire strands for rotation to a normally closed position.

These and other objects of the invention will be set forth in the details of the construction as seen in several views of the drawings.

BRIEF DESCRIPTION OF THE DRAWINGS

The preferred embodiment of the invention is illustrated in the following drawings, wherein.

DETAIL DESCRIPTION OF THE EMBODIMENT

Figure 1:
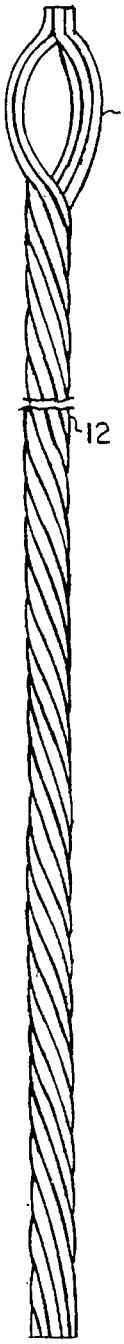
FIG. 1 is a length of a bare 7-strand cable with its insertion first end shaped to a desired form for spinning resinous anchor material.
Figure 2:
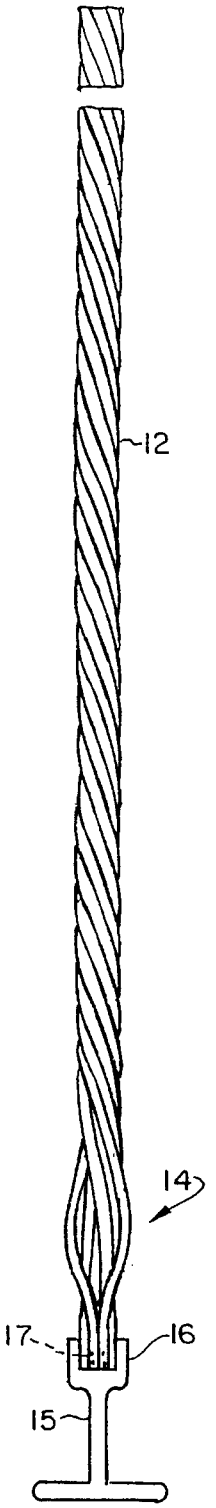
FIG. 2 is a schematic view of the cable of FIG. 1 being twisted by a tool at its opposite end to open the strands thereof.

Current techniques for anchoring cable fixtures in resinous anchor material involve spinning the cable fixture to achieve mixing of the anchor material, and this technique is directed at the spinning of a cable into resinous material to achieve proper mixing.

Techniques employed to date involve the attaching of an end piece of various constructions to the end of the wire strand cable by conical jaws or swaging of the end piece. As this technique limits the possible use of the cable it is therefore desirable to be able to install a bare cable. Cables to date have been substantially the same as the depth of hole into which they will be installed. This improvement in insertion technique allows cables longer than borehole depth to be simply and easily inserted and anchored in proper resin material.

As the spiral multi-strand cable is inherently very rigid and strong it is possible to apply the appropriate amount of torque and thrust on the cable through splayed cable strands. To achieve the transfer of adequate torque and thrust, the end of the cable is twisted in such a manner as to unwind the cable a few revolutions. This effectively separates the strands. The separated strands can then be inserted into a special wrench which is configured to hold and twist the cable. The wrench consists of a tubular body with a tool end formed with one center hole surrounded by six perimeter holes evenly spaced angularly around the center hole. These holes are larger than the individual cable strands and allow ready passage of the cable strands through them. The body of the wrench employed has a length to allow for the support of any desired length of cable during the insertion process.

In use the cable is inserted into the wrench, the cable is pushed to the full depth of the wrench, the wrench is turned in the direction of the cable's normal twist and then seated in the installation equipment. The bare cable is now ready for installation into the resin. A slow speed cure resin is selected to improve and ensure proper mixing of the resin during insertion. For improved mixing results the cable may have a birdcage or nutcage on the insertion end to act as a mixer for the resin. The resin of proper size and volume for the application is inserted into the drill hole in the rock and the insertion end of the cable follows. The cable is thrust up the hole manually until the resistance of the resin in the hole halts the motion. The wrench is then placed into the insertion equipment. The insertion equipment then rotates the cable rapidly and applies a slow, deliberate thrust to the cable, continuing until the cable is fully inserted into the hole. Once the cable is fully inserted into the hole the cable is spun vigorously briefly and then the cable is held fast. The resin will take an initial set during the holding fast of the cable. The insertion equipment and wrench are then removed from the cable by backing off on the thrust and lowering the wrench by hand from the cable. The splayed end strands of the cable can be rewound as the wrench is removed or by hand after the wrench removal. The cable is then ready to attach which ever end fixtures that the particular application will demand.

Figure 3A:
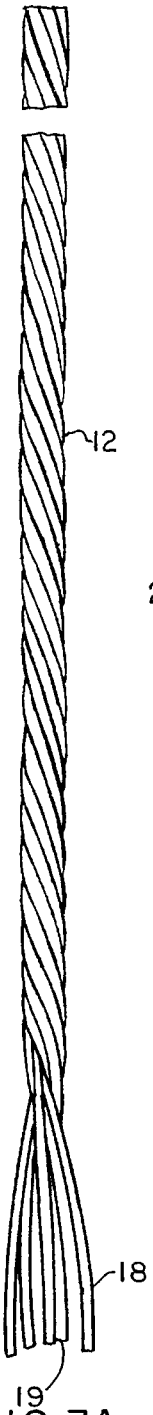
FIG. 3A is a schematic view of the cable having its 7-strands opened out.
Figure 3B:
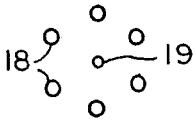
FIG. 3B is a schematic end view to show the spread ends of the cable strands.

In the drawings, FIG. 1 is an example of a bare spirally formed multi-strand cable 12 having a birdcage formation 13 on its lead end, although other formations like a nutcage or buttons may also be provided. After the desired cable length is determined the trailing end 14 to be used to effect the insertion of the cable 12 is then reverse twisted, either by hand or by a suitable tool 15 formed with a socket 16 having a center pad 17 and an annular space, so that on reverse rotation of the tool 15 relative to the direction of the spiral wrap of the outer strands 18 relative to a king strand 19 as in FIG. 3A and 3B, the cable strands 14 and 19 on trailing end 14 are splayed.

Figure 4B:
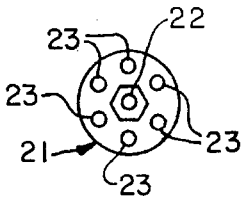
FIG. 4B is an end view of the cable strand receiving end of the wrench of FIG. 4A.
Figure 4A:
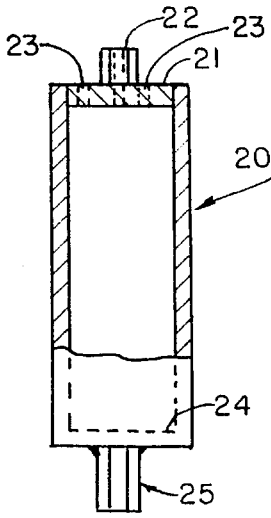
FIG. 4A is a partially sectioned wrench employed to grip the cable of FIG. 3A to enable spinning of the cable at an appropriate time.
Figure 5:
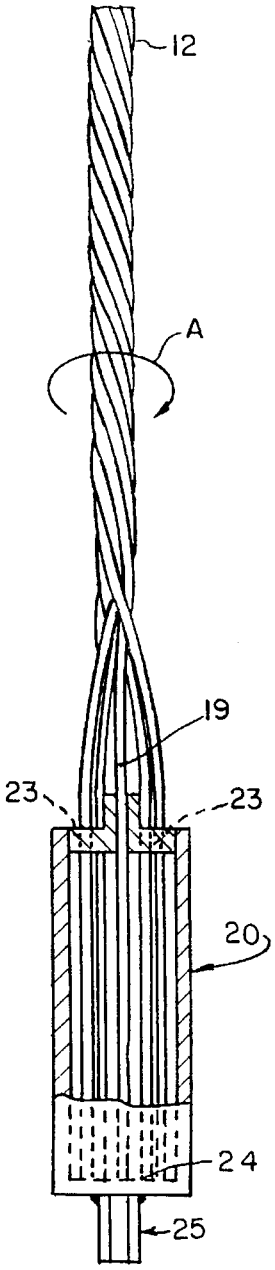
FIG. 5 is a schematic view, partly in section, to show the cable strands inserted into the full length of the wrench of FIG. 4A.
Figure 6:
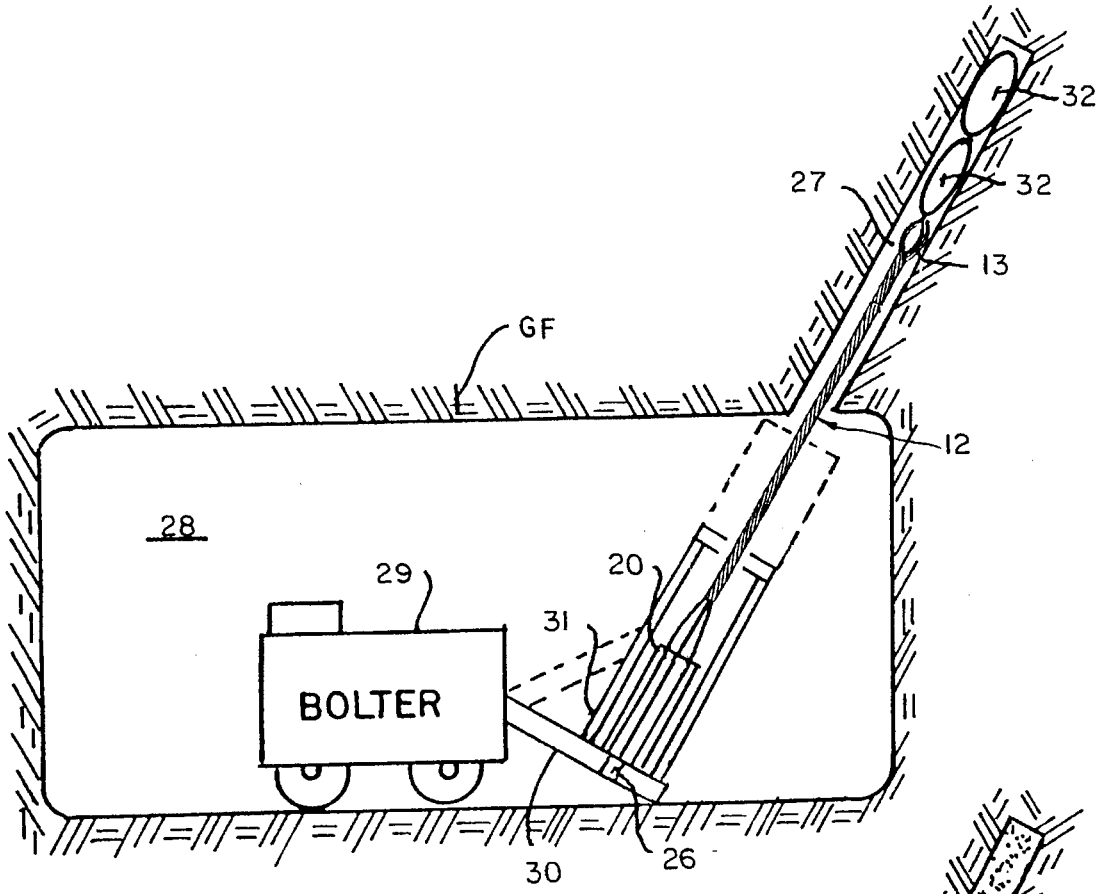
FIG. 6 is a schematic view of a mine passage having a borehole formed in the ceiling, and a Bolter machine for operating a cable wrench mounted in the Bolter mast structure.

FIGS. 4A and 4B illustrate an insertion wrench 20 in the form of a tubular body 21 which may have a desired length depending on the length of cable 12 to be left outside of the borehole. That body 21 is formed with an end closure device 24 which contains the cable strands 18 and 19. The arrangement is secured by directing the king strand 19 into the central aperture 22 and the other strands 18 into separate apertures 23. The splayed strands slide rather easily into the gripper device or wrench 20 which consists of six concentric apertures 23 around a central aperture 22 (see FIG. 5). The wrench 20 is rotated relative to cable 12 to unwind suitable lengths of the strands 18 and 19 of cable 12 until the strands 18 and 19 reach the opposite end closure 24. Thus a desired length of cable 12 is obtained by the length of the body 21. The end closure 24 is provided with a drive stub shaft 25 of hex or square shape which fits into a matching socket in a Bolter 29 seen in FIG. 6. Once the cable strands 18 and 19 are slidably mounted in the body 21, the body 21 is rotated in the direction of the spiral strands 18 as indicated by the directional arrow A. The direction of rotation can be right or left depending on the cable strand twist. Thus, the rotation of the body 21 is dictated by the twist in the cable 12 seen in FIG. 5, the lead end birdcage 13 not being shown. The bare cable 12 is ready for insertion in a borehole 27 formed in the geologic formation GF in which a passage 28 has been formed in the usual manner. An access Bolter machine 29 is brought to a suitable location relative to the borehole 27 and the boom 30 of Bolter 29 is extended to support a mast 31 which carries and guides the rotary driver 26. Manipulation of the Bolter arm or boom 30 is probably necessary to get the mast 31 into a position for allowing the wrench 20 to align the cable 12 so it is able to enter the borehole 27. Of course, resinous material cartridges 32 need to be manually started in the borehole 27. Once the desired alignment of the cable 12 in the axis of the borehole 27 is achieved, and the stub shaft 25 is engaged in the driver 26, the controls (not necessary to show) on the Bolter 29 can be operated to power the driver 26 to rotate the cable 12 while advancing the wrench 20 up the mast 31 until the cable lead end 13 encounters resistance as a signal to speed up the cable rotation for thoroughly mixing the resinous material in one or more cartridges 32.

Figure 7:
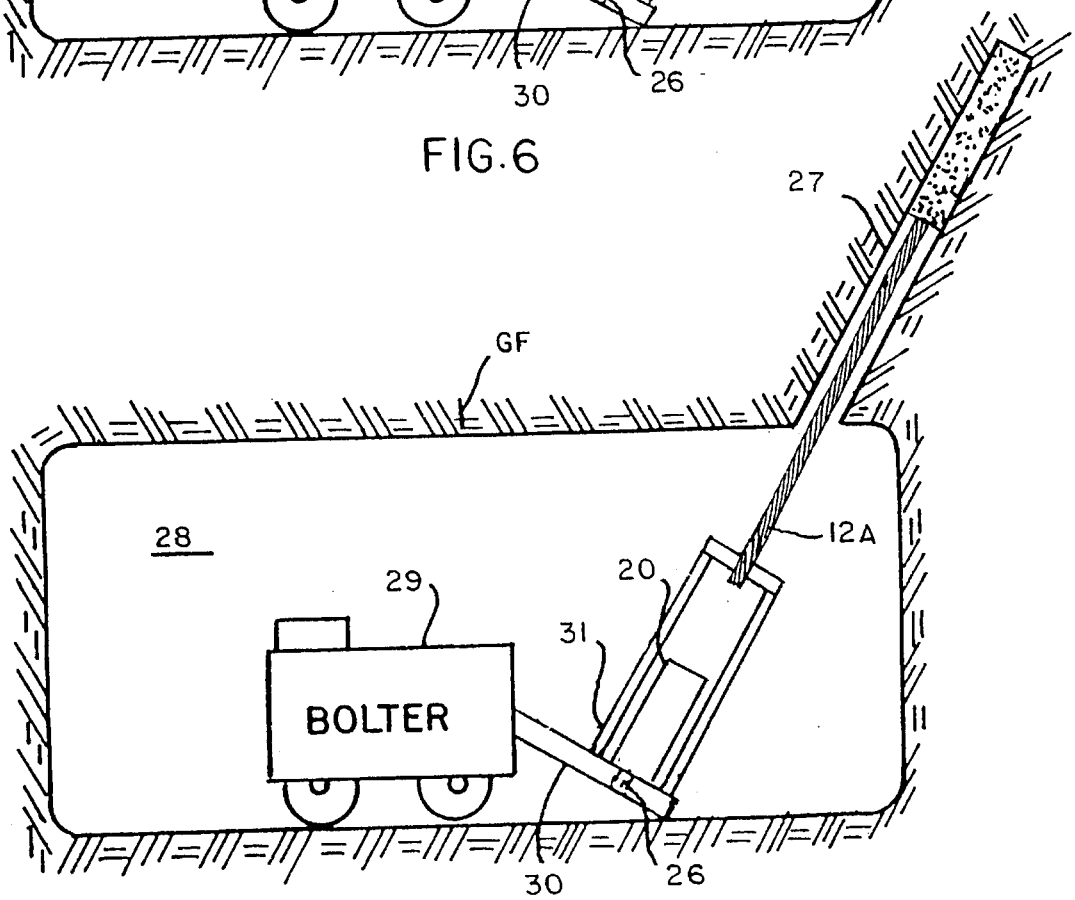
FIG. 7 is a schematic view of the Bolter machine being withdrawn to leave an exposed end of the cable in the passage.

When the mast 31 and the driver 26 have been returned to the position of FIG. 7, the wrench can be rotated in a direction to return the cable strands 18 to a normal position wrapped around the king strand 19. The cable length 12A outside of the borehole 27 is left for subsequent use with attachment devices (not shown).

Figure 8:
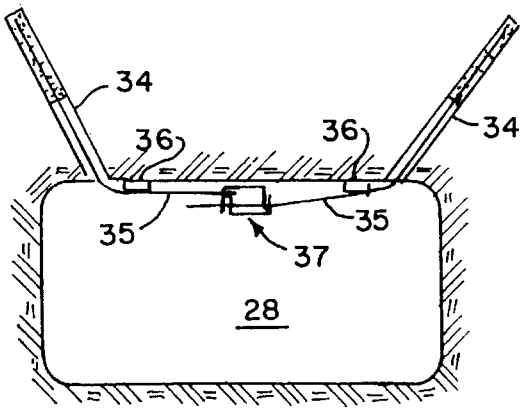
FIG 8 is a schematic view of a mine passage in which cables mounted in boreholes have the exposed ends joined in a splice plate with one cable end exposed to receive a tensioning device (not shown)

The view of FIG. 8 illustrates the application of a pair of cables 12 anchored, one in each of boreholes 34 with end portions 35 of the cable 12 exposed to be engaged over domed truss plates 36, and then joined in a common splice plate assembly 37 in the usual manner seen in pending application Ser. No. 08/185,262 filed Jan. 24, 1994 by Castle, et al. The cables 12 are schematically shown as a single line.

Figure 9:
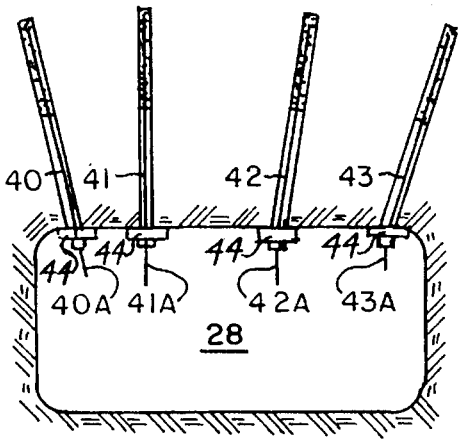
FIG. 9 is a further schematic view of a mine passage having several resinous anchored cables secured in boreholes with exposed ends secured in support plates by jaw elements which allow for the attachment of tension devices for adjusting the tensile loads of the cables.

The view of FIG. 9 is a further example of the utility of the system and apparatus heretofore disclosed in FIG. 7. The difference is that a plurality of single cables 40, 41, 42 and 43 may be individually installed in boreholes radiating out from a mine passage 28 as seen in FIG. 9. Here again the single lines represent twisted cables 40–43. When so installed, the respective exposed ends 40A, 41A, 42A and 43A of cables 40–43 can be engaged by a cable body and jaws device which will allow a tension device to be attached to the exposed ends for increasing the tension in one or more of the cables 40–43.

Figure 10:
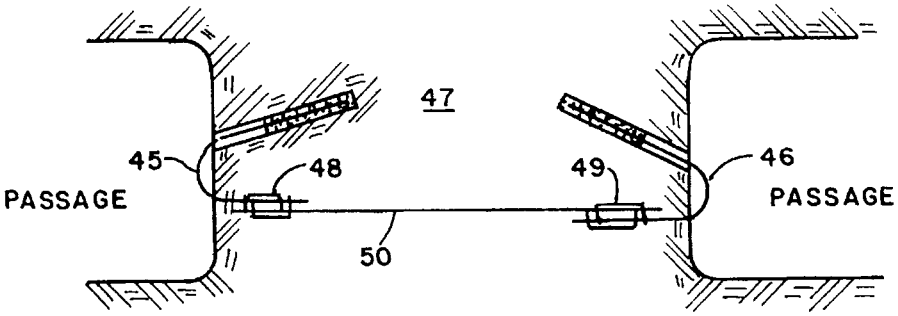
FIG. 10 is a schematic view of a pillar between separate passages in which the pillar is embraced in a circumferentially installed cable system to reinforce the pillar.
Figure 11:
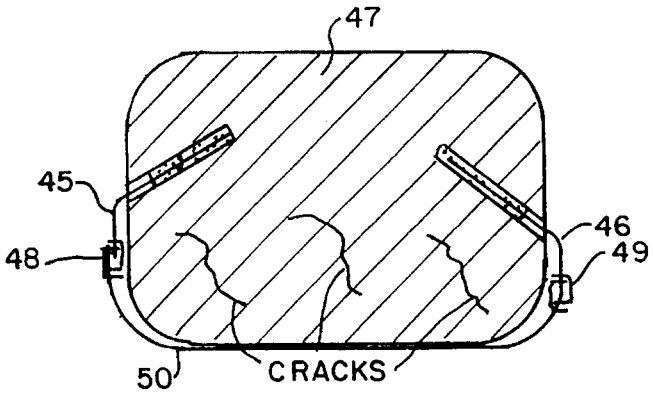
FIG. 11 is a sectional view of the pillar in FIG. 10 to further illustrate the cable installation.

Turning now to FIGS. 10 and 11, there is illustrated a special installation of a cable system in which cables 45 and 46 (represented as single lines) are installed in opposite sides of a pillar of geologic formation 47 so that the exposed ends of the respective cables can be joined through the use of splice plates 48 and 49 by a separate length of cable 50. The view of FIG. 11 is a sectional view of the pillar seen in FIG. 10 so that the reference numerals are again applied to the described parts of the installation.

The foregoing description has set forth in detail a preferred embodiment of the invention in terms of a method and apparatus for installing cables in the geologic formation of a mine passage.

What is claimed is:

1. A method of anchoring a multi-strand cable in a borehole formed in a geologic formation, said method comprising the steps of:

a) placing resinous material in the borehole;

b) opening a normally closed trailing end of the multi-strand cable which has a lead end for insertion in the borehole, wherein the cable strands at the trailing end are in a separated and spread out, unwound form from the normal closed cable position;

c) gripping the individual unwound cable strands at the trailing end of the cable by inserting the individual unwound cable strands in a wrench body;

d) feeding the lead end of the cable into the borehole to push the resinous material into the borehole;

e) spinning the cable by rotation of the wrench body to mix the resinous material by the rotational action of the lead end of the cable;

f) allowing the resinous material to cure to anchor the cable in the borehole; and g) detaching the wrench body from the cable strands at the trailing end of the cable to allow the cable strands at the trailing end of the cable to return to the closed cable position.

2. The method set forth in claim 1 wherein the step of opening the normally closed trailing end of the cable includes the use of a tool having a socket therein for positioning the cable strands at the trailing end of the cable in the separated and spread out, unwound form.

3. The method set forth in claim 1 wherein the step of gripping a length of the spread out form of the cable strands allows a matching length of cable to project into the passageway after the cable is anchored in the borehole.

4. The method set forth in claim 1 wherein the step of detaching the wrench body from the cable strands at the trailing end of the cable is by rotation of the gripped cable strands at the trailing end of the cable.

5. An anchor insertable into a borehole, said anchor comprising:

a) at least one resinous material containing cartridge insertable into the borehole;

b) a multiple strand elongated, spirally wound cable having a lead end insertable into the borehole adapted to engage and continue the insertion of said at least one cartridge into the borehole, said cable having a trailing end, wherein said trailing end is adapted to be spirally unwound to present said multiple strands at said trailing end of said cable in an expanded, separated position;

c) a wrench body having apertures therein which are adapted to receive said separated strands of said trailing end of said cable; and d) a Bolter machine engaged with said wrench body adapted to spin said wrench body and said cable and to advance said lead end of said cable into the borehole to penetrate said at least one resinous material cartridge and to mix said resinous material to anchor said cable in the borehole.

6. The anchor set forth in claim 5 wherein said wrench body has an elongated hollow body closed at one end with a head member spaced from said closed end, said head member having a plurality of apertures therein, wherein said apertures are spaced apart and sufficient in number to receive said spiral, unwound multiple strands at said trailing end of said cable.

7. The anchor set forth in claim 5 wherein said wrench body has a hollow interior adapted to contain a length of said spirally unwound, separated multiple strands at said trailing end of said cable therein.

8. An anchor insertable into a borehole in a geologic structure, said anchor comprising:

a) resinous material insertable into the borehole;

b) a multiple strand elongated cable spirally wound in one direction and having a first lead end adapted to be fitted in the borehole to engage and push said resinous material into the borehole, and a second trailing end adapted to extend from the borehole to expose the multiple strands of the cable;

c) a manually manipulated tool having a socket therein engageable with said multiple strands of said cable at said trailing end, wherein said tool is movable in a direction to separate said multiple strands of said cable at said trailing end; and d) powered drive means engaged with said separated multiple strands at said trailing end of said cable and operable to spin said cable in a direction to advance said first lead end of said cable to penetrate said resinous material and to mix said resinous material to anchor said cable in the borehole.

* * * * *